US008187370B2

(12) United States Patent
Dunn et al.

(10) Patent No.: US 8,187,370 B2
(45) Date of Patent: May 29, 2012

(54) HORIZONTAL BULK OIL SEPARATOR

(75) Inventors: Stephen B. Dunn, Bethlehem, PA (US); Ralph C. Longsworth, Allentown, PA (US)

(73) Assignees: SHI-APD Cryogenics, Inc., Allentown, PA (US); Sumitomo Heavy Industries, Ltd., Tokyo (JP)

( * ) Notice: Subject to any disclaimer, the term of this patent is extended or adjusted under 35 U.S.C. 154(b) by 1187 days.

(21) Appl. No.: 11/486,414

(22) Filed: Jul. 13, 2006

(65) Prior Publication Data

US 2008/0011550 A1 Jan. 17, 2008

(51) Int. Cl.

| | |
|---|---|
| ***B01D 19/00*** | (2006.01) |
| ***B01D 45/08*** | (2006.01) |
| ***F01M 11/08*** | (2006.01) |
| ***C02F 1/40*** | (2006.01) |

(52) U.S. Cl. ..... 96/155; 210/521; 210/537; 184/6.23; 55/465

(58) Field of Classification Search ..... 184/6.17, 184/6.23; 62/471, 473; 55/320, 322, 323, 55/465; 210/531, 537; 96/260

See application file for complete search history.

(56) References Cited

U.S. PATENT DOCUMENTS

| | | | | |
|---|---|---|---|---|
| 1,722,870 | A * | 7/1929 | Waters | 55/413 |
| 2,906,101 | A | 9/1959 | McMahon et al. | |
| 3,917,474 | A * | 11/1975 | Heckenkamp et al. | 96/189 |
| 4,359,329 | A * | 11/1982 | Willeitner | 55/320 |
| 4,666,473 | A * | 5/1987 | Gerdau | 95/268 |
| 5,553,460 | A | 9/1996 | Isaacs | |
| 5,735,139 | A * | 4/1998 | Lord et al. | 62/470 |
| 5,902,483 | A * | 5/1999 | Edmondson | 210/521 |
| 6,017,205 | A | 1/2000 | Weatherston | |
| 6,488,120 | B1 | 12/2002 | Longsworth | |
| 6,880,360 | B2 | 4/2005 | Barratt et al. | |
| 7,032,410 | B2 | 4/2006 | Barratt et al. | |
| 2002/0162352 | A1 * | 11/2002 | Ring et al. | 62/471 |
| 2003/0014951 | A1 * | 1/2003 | Crouse | 55/322 |
| 2004/0065110 | A1 | 4/2004 | Barratt et al. | |
| 2005/0022551 | A1 | 2/2005 | Barratt et al. | |
| 2006/0123833 | A1 | 6/2006 | Flanigan et al. | |

FOREIGN PATENT DOCUMENTS

| | | |
|---|---|---|
| CN | 1717273 | 1/2006 |
| JP | 2-120675 | 9/1990 |
| JP | 2001-140759 | 5/2001 |
| JP | 2006-501985 | 1/2006 |
| WO | 20041030792 | 4/2004 |

OTHER PUBLICATIONS

Chinese Office Action dated Jan. 12, 2009, from the corresponding Chinese Application.

R.C. Longsworth, Helium Compressor for GM and Pulse-tube Expanders in "Advances in Cryogenic Engineering", vol. 4, Amer. Inst. of Physics, 2002, pp. 691-697.

Japanese Office Action dated Feb. 1, 2011, from corresponding Japanese Application No. 2007-154240.

* cited by examiner

*Primary Examiner* — Michael Mansen
*Assistant Examiner* — Robert Reese
(74) *Attorney, Agent, or Firm* — Katten Muchin Rosenman LLP

(57) ABSTRACT

A high separation efficacy, compact, bulk oil separator oriented horizontally and used with a scroll-type oil-lubricated compressor unit adapted to compressing helium. The horizontal bulk oil separator contains an integral oil reservoir and removes more than 99.9% of the oil from the helium that exits. The bulk oil separator contains successive chambers where oil separates from the gas by impingement.

15 Claims, 4 Drawing Sheets

HORIZONTAL BULK OIL SEPARATOR

This invention relates generally to helium compressor units for use in cryogenic refrigeration systems, operating on the Gifford McMahon (GM) cycle. More particularly, the invention relates to an improved bulk oil separator that is oriented horizontally and is used with a scroll type oil-lubricated compressor unit adapted to compressing helium.

BACKGROUND OF THE INVENTION

Helium is typically compressed using air-conditioning type compressors, in which a significant amount of oil flows through the compression chamber with the helium in order to keep it cool. The purpose of oil in GM type cryogenic refrigerator compressors is both for lubrication and to absorb the heat produced in the process of helium compression. It is extremely important that the helium delivered to the expander be virtually oil free. Bulk oil separators are used to ensure removal of such oil injected during the compression process. The bulk oil separator serves as an oil reservoir for the system that is drawn down as oil is transferred to the adsorber over the life of the compressor system.

The basic principal of operation of a GM cycle refrigerator is described in U.S. Pat. No. 2,906,101 to McMahon, et al. The GM cycle has become the dominant means of producing cryogenic temperatures in small commercial refrigerators primarily because it can utilize mass produced oil-lubricated air-conditioning compressors to build reliable, long life, refrigerators at minimal cost. GM cycle refrigerators operate well at pressures and power inputs within the design limits of air-conditioning compressors, even though helium is substituted for the design refrigerants. Typically, GM refrigerators operate at a high pressure (Ph) of about 2 MPa (300 pounds per square inch absolute) (psia), and a low pressure of about 0.8 MPa (117 psia).

Air-conditioning compressors are built in a wide range of sizes and several different designs. Means of providing additional cooling to adapt these compressors to compressing helium are different for different compressors. For example, compressors that draw approximately 200 to 600 W are typically reciprocating piston types which are cooled by adding air cooled fins to the compressor shell. Between about 800 to 4,500 W, the most common compressor is a rolling piston type with low pressure return gas flowing directly onto the compression chamber. In rolling piston compressors, oil flows into the compression chamber along with the helium and absorbs heat from the helium as it is being compressed. Most of the oil separates from the helium in the compressor shell which is at high pressure. U.S. Pat. No. 6,488,120 to Longsworth describes the cooling of helium, oil, and the compressor shell by wrapping a water cooling tube around the shell, and further wrapping a helium cooling tube and an oil cooling tube over the water tube. Cooled oil is then injected into the return helium line. In effect, the compressor serves as an oil pump. The amount of oil pumped is typically about 2% of the displacement.

The Hitachi Corporation scroll compressors draw between 5 and 9 kW and have return gas flow directly into the scroll. Oil can be injected into the inlet and discharged with the helium into the shell at high pressure. Most of the oil separates from the helium and collects in the bottom of the compressor, similar to the rolling piston compressor described above. Unlike the smaller compressor, for this type of compressor, cooling the shell with a water cooling tube wrapped around it is not effective. Here, heat from the helium and oil is removed by an after-cooler, that is external to the compressor shell, which is either air or water cooled.

The Copeland corporation scroll compressors for air-conditioning service draw between 5 and 15 kW. These compressors differ from the Hitachi design in that return gas flows into the shell, which is at low pressure, rather than directly into the scroll. In the standard vertical orientation, the scroll is above the motor. No means exist to have cooling oil flow into the compression chamber with the helium. Copeland has modified two compressors, a 5 and a 7.5 kW compressor, to circulate oil for cooling helium by collecting high pressure oil in the discharge plenum above the scroll and having it flow out through a special port to be cooled in an external after-cooler. Another special return port brings oil back into the scroll near low pressure where it mixes with helium that is being compressed.

A description of the construction and operation of a scroll compressor, and the specific changes to adapt the Copeland standard unit to compressing helium, is found in U.S. Pat. No. 6,017,205 to Weatherston, et al. A compressor system that uses the larger of the two compressors that are manufactured for helium service, i.e., Model HC-10® compressor (SHI-APD Cryogenics), together with a description of the entire compressor system, of which the compressor is an essential component, is described in R. C. Longsworth, "Helium Compressor for GM and Pulse-tube Expanders", in "Advances in Cryogenic Engineering", Vol. 47, Amer. Inst. of Physics, 2002, pp 691-697.

To reduce the cost of applying the above scroll compressors to applications that require oil injection for cooling, Copeland successfully oriented the compressors horizontally. In the horizontal orientation, oil in the bottom of the compressor at low pressure flows into the scroll due to gravity along with the gas being compressed. The only modification to a standard vertical compressor is the addition of a port at the traditional bottom center of the compressor. In the horizontal orientation, oil, which would normally be pumped from the oil sump in the traditional bottom of the compressor up the drive shaft to lubricate the bearings and scroll, is directed at the end of the drive shaft after it is cooled in an after-cooler. The amount of oil that is circulated is much greater than the amount that is needed to lubricate the bearings. Most of the oil bypasses the motor and flows directly into the compressor shell near the inlet to the compression chamber in the scroll set. This not only reduces the input power and noise level, but it also results in near constant oil levels in the compressor. The bulk oil separator, which is external to the compressor, serves as the oil reservoir for the compressor system. Conventional vertical separators such as Model 603® (Temprite), produce a low separation efficiency and are difficult to fit in the available space. Using a scroll compressor oriented horizontally offered space underneath the compressor for a horizontal bulk oil separator.

The "Horizontal Oil Separator/Reservoir" described in U.S. Pat. No. 5,553,460 to P. E. Isaacs has an oil separator section that is separated from an oil reservoir section and is at a slightly higher pressure so that oil is transferred from the bottom of the separator section to the top of the reservoir section where it is above the level of the oil there. Oil flows out of the reservoir section through a tube that picks it up from the bottom of the reservoir. This arrangement prevents oil from flowing back into the separator region.

Use of the 98 cc displacement Copeland scroll type compressor in a horizontal configuration, and in a package the same size as the smaller HC-10® compressor, imposed severe constraints on the size and orientation of the bulk oil separator.

The use of a horizontal bulk oil separator that fit under the compressor enabled the packaging goals to be achieved but placed severe constraints on the design of a compact bulk oil separator with high separation efficiency and high sensitivity of an oil level switch that enables the amount of oil that can be collected in the adsorber to be limited.

What is needed is a horizontal bulk oil separator which is compact, has a high separation efficacy, and which avoids the problems of prior units.

SUMMARY OF THE INVENTION

It is an object of the present invention to provide a horizontal bulk oil separator with very high separation efficiency in a compact size by means of a series of separation chambers that have ports for gas in the upper part of the baffles and ports for oil in the lower part of the baffles.

It is also an object of the present invention to provide a new and improved horizontal bulk oil separator which removes more than 99%, and preferably more than 99.9% of the oil from helium that exits a horizontal scroll compressor where oil enters the compression chamber at a rate of about 2% of the displacement.

It is a further object of the present invention to provide a horizontal bulk oil separator having oil settling sections that remove gas bubbles from the oil and enable the use of an opto-electronic oil level sensor in the final section of the separator.

In accordance with the invention, pressure drop is low because oil is separated from the gas by impingement, rather than by flow though screens or some other matrix. Gas bubbles separate from the oil as it flows through successive chambers so an opto-electronic oil level sensor in the last chamber can be used to sense the oil level and shut the compressor off before oil carries from the adsorber to the cold expander.

Accordingly, it is an object of the present invention to provide a horizontal bulk oil separator which is an integral separator-reservoir which is simpler to construct. In accordance with the invention, the separator is also a reservoir.

Accordingly, it is an object of the present invention to provide a horizontal bulk oil separator having a level sensor in the last section that has a very high sensitivity to the last 10% change in the amount of oil that is transferred from the reservoir to the adsorber over the life of the compressor. It is designed to implement the "Fail Safe" concept described in our U.S. Pat. No. 6,488,120 by R. C. Longsworth, which is incorporated herein in its entirety. Thus, the compressor itself will shut down because of a protective switch or even seize for lack of oil before any oil carries outside the compressor unit. Components are sized so that under normal circumstances, the unit and the connected refrigeration system can run for more than a selected design life, for example, ten years, before the compressor shuts down because the limit of oil that can be transferred to the adsorber has been reached.

To achieve these and other advantages and in accordance with the purpose of the present invention there is provided a horizontal bulk oil separator and reservoir comprising:

a shell having an inlet tube which directs an inflow mixture of oil and gas to impinge on a plate;

one or more baffles fixedly installed within and dividing said shell into sections wherein said inflow mixture of oil and gas impinges upon;

cut-outs on said one or more baffles above oil level for gas to flow through and below oil level for oil to flow through from section to section;

a final baffle provided with a single cut-out for gas wherein the oil is forced to spill over into a final section, said single cut-out having a lip that maintains a minimum oil level between the inlet head of the shell and said final baffle, the oil level in the final section between said final baffle and an outlet head of the shell being optionally lower than said lip; and an oil outlet tube which directs an outflow of oil.

The helium and oil flow into the bulk oil separator and impinge on the head of the bulk oil separator. Most of the oil drops into the first section of the separator. In a bulk oil separator having an outside diameter of 1.015 cm oil is retained at a depth of 5 cm in three sections that are separated by baffles that have cut-outs for gas above the oil and ports below the oil for oil to flow from section to section. More oil is removed from the gas as it impinges on successive baffles. The last baffle does not have ports for the oil so it is forced to spill over the last cut-out for the gas into the last section which has an oil level switch. These sections allow gas bubbles to rise from the oil so that the oil that spills over into the last section is free of bubbles that would otherwise introduce an error in an opto-electronic type oil level switch. The oil level drops from 7.5 cm to 5 cm as 270 ml of oil is transferred to the adsorber over many years, i.e. more than 5 years, then drops only in the last section, with the level sensor, to 3.5 cm as an additional 30 ml of oil is transferred. This arrangement gives a high sensitivity to the operation of the oil level switch in implementing the "Freedom" fail safe concept. Only about 30 ml causes the level to drop in the last section to a level of 3.5 cm at which point the oil level switch opens. The present invention maximizes the sensitivity of the cut-out to a change in the amount of oil in the bulk oil separator. The 500 ml of oil that remains in the inlet sections of the bulk oil separator continues to separate the gas bubbles from the oil.

In another embodiment, there is provided a horizontal bulk oil separator with an integral reservoir comprising: a shell; passages for an inflow mixture of gas and oil to flow from an inlet to an outlet end within the shell; an inlet tube that directs the inflow mixture to impinge on a plate; one or more baffles that have cut-outs for gas to flow above the level of the oil and ports for the oil to flow near a bottom of the shell; an outlet port for gas above the maximum oil level and an outlet port for oil near the bottom of the shell; and a uniform oil level that is above said outlet port for oil.

In accordance with yet another aspect of the invention, a method for providing separation of oil from helium in a horizontal bulk oil separator and exiting a horizontal scroll compressor comprises the steps of: inputting a gas and oil mixture flow into a shell;

impinging said mixture on an inlet head of the bulk oil separator; allowing the mixture to impinge upon one or more baffles fixedly installed within and dividing said shell into sections; separating the gas from oil by flowing said mixture through upper and lower cut-outs in said baffles, the upper cut-out for gas to flow through and the lower cut-out for oil to flow through from section to section; forcing oil to flow over a final baffle having a single cut-out and a lip that maintains a minimum oil level between the inlet head of the shell and said final baffle, the oil level between the final section between said final baffle and an outlet head of the shell optionally being lower than said lip; and directing an outflow of oil through an oil outlet tube.

The invention is also directed to a bulk oil separator with an integral reservoir which comprises:

a shell; a means for directing an inflow mixture to impinge upon an inlet head of the bulk oil separator; one or more baffles having means for gas to flow above a level of oil and means for oil to flow near a bottom of the shell; a means for directing an outflow of gas; and a means for directing an outflow of oil.

Other objects and advantages of the invention will become apparent with reference to the following description and the accompanying drawings.

BRIEF DESCRIPTION OF THE DRAWING

FIG. 2A is a plane cut-out view of baffles 45*a* and 45*b*.

FIG. 2B is a plane cut-out view of baffle 45*c*.

FIG. 4A is a plane cut-out view of a baffle having an upper cut-out.

DESCRIPTION OF THE PREFERRED EMBODIMENT

Figure 1:
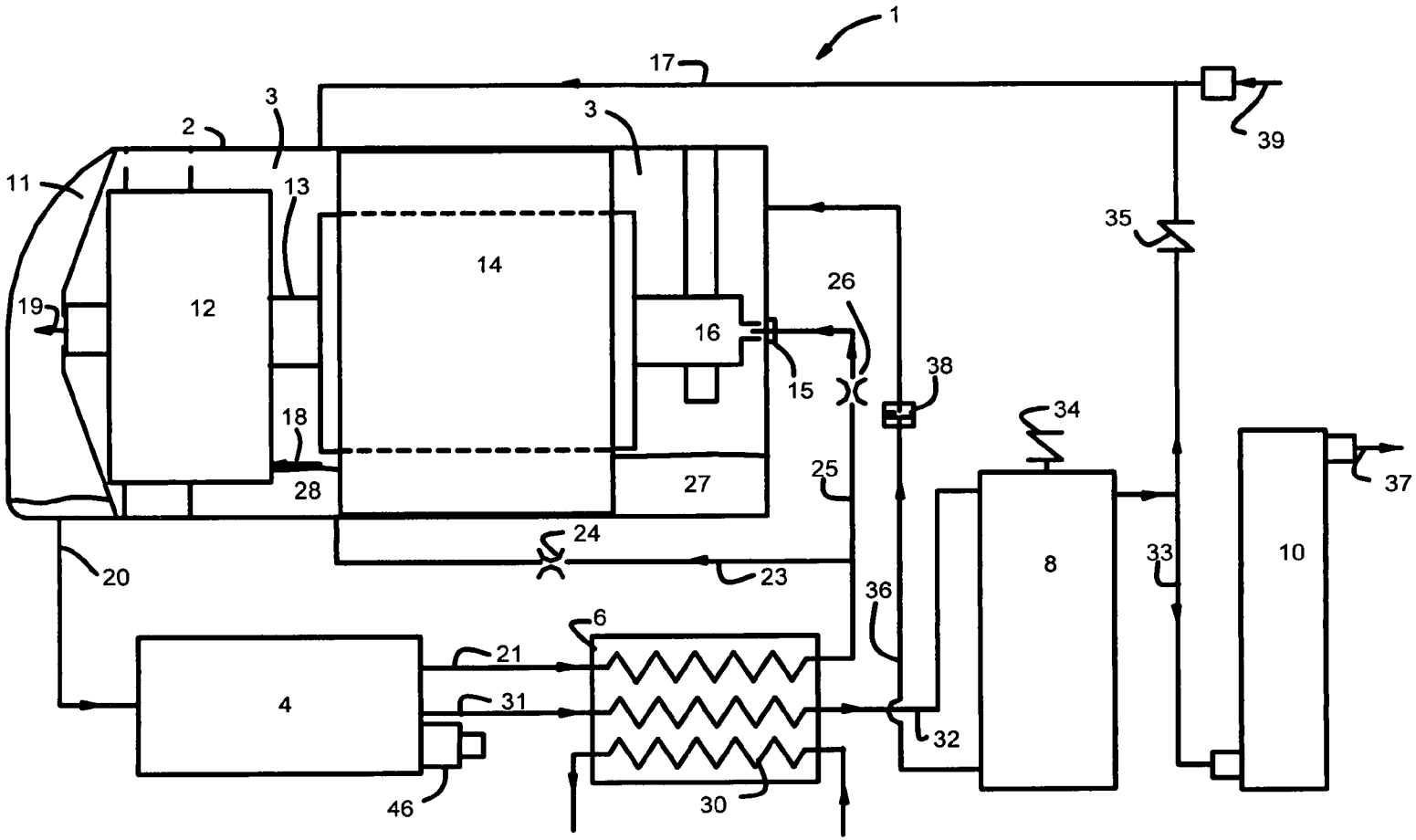
FIG. 1 is a schematic diagram of an oil-lubricated helium compressor system illustrating the relation between the horizontal bulk oil separator of the present invention and other compressor system components.

Referring now to the drawings and more specifically to FIG. 1, there is shown the bulk oil separator 4 of the present invention in relation to the other essential components of compressor system 1. The shell 2 of a Copeland compressor that has a scroll set 12 with a displacement of 98 mL, is driven by motor 14 through drive shaft 13. The horizontal orientation allows cooling oil in sump 28 to flow by gravity in the scroll set along with helium, as designated by arrow 18. The shell 2 has a volume 3 at the return (low) pressure (about 0.8 MPa) and a volume 11 at supply (high) pressure (about 2 MPa).

The compressor is a type that is used for compressing refrigerants used in air-conditioning service and is typically vertically oriented with the scroll above the motor and the oil sump at the traditional bottom. The end of the drive shaft 13 below the motor 14 contains an oil pump 16 that picks up oil from the traditional sump, (when it is oriented vertically), to pump it through a hole in drive shaft 13 that has ports to lubricate a lower bearing, an upper bearing, and to inject some oil into the compression chambers in the scroll set. Copeland has modified their standard compressor so it can be operated horizontally, by adding port 15 that allows cooled oil to impinge on the inlet to pump 16.

Excess oil drops into sump 27 and flows through small passages in the motor windings to get to sump 28. The addition of an oil by-pass line 23 to bring oil directly into sump 28 reduces the amount of excess oil dropping into sump 27 where it backed up and caused increased power consumption and vibration as it flowed through the "air gap" in the motor. With oil by-pass line 23, oil levels in sumps 27 and 28 remain nearly constant during operation of the compressor, as determined by the height of the inlet to scroll set 12. At the design operating pressures, 2.0/0.8 MPa (high/low), an oil flow rate of about 7 L/m is needed to keep the helium temperature at a maximum of about 70° C. The sizes of orifices 24 and 26 set the flow rates at about 2 L/m to the bearings, through line 25 and port 15, and 5 L/m directly into sump 28.

With reference to FIG. 1, arrow 19 denotes the helium/oil mixture leaving the compression chamber and flowing into high pressure plenum 11. From there the mixture flows through line 20 to the bulk oil separator 4 where most of the oil leaves through a line 21 and less than 0.1% of the oil leaves with the helium through line 31. Both flow streams in lines 21 and 31 flow through after-cooler 6 which cools both streams by the counterflow of cooling water through 30. Cooled oil is split into a first stream that flows through line 25 and orifice 26 into port 15 where it provides lubrication for the bearings, and into a second stream that flows through line 23 and orifice 24 into sump 28. Cooled helium flows through line 32 to oil separator 8 which removes most of oil that is not separated in bulk oil separator 4. Separated oil collects in the bottom of 8 and returns to low pressure volume 3, in compressor 2, through line 36 and filter/orifice 38. From separator 8 the helium with only a trace of oil in the form of a mist flows through line 33 to adsorber 10 which removes all but oil vapor before it leaves through supply line 37. The adsorber traps and holds contaminants. Its primary purpose is to remove all traces of elements, such as water vapor, from the helium gas, but principally oil. Supply line 37 takes the helium to the expander (not shown). Helium returns from the expander at low pressure through line 39 and continues on through line 17 to flow into compressor volume 3. The system is protected from being over pressurized by atmospheric relief valve 34. During cool down, or operation without lines 37 or 39 connected, excess pressure difference between the high pressure and low pressure side of the system is limited by internal relief valve 35.

Figure 2:
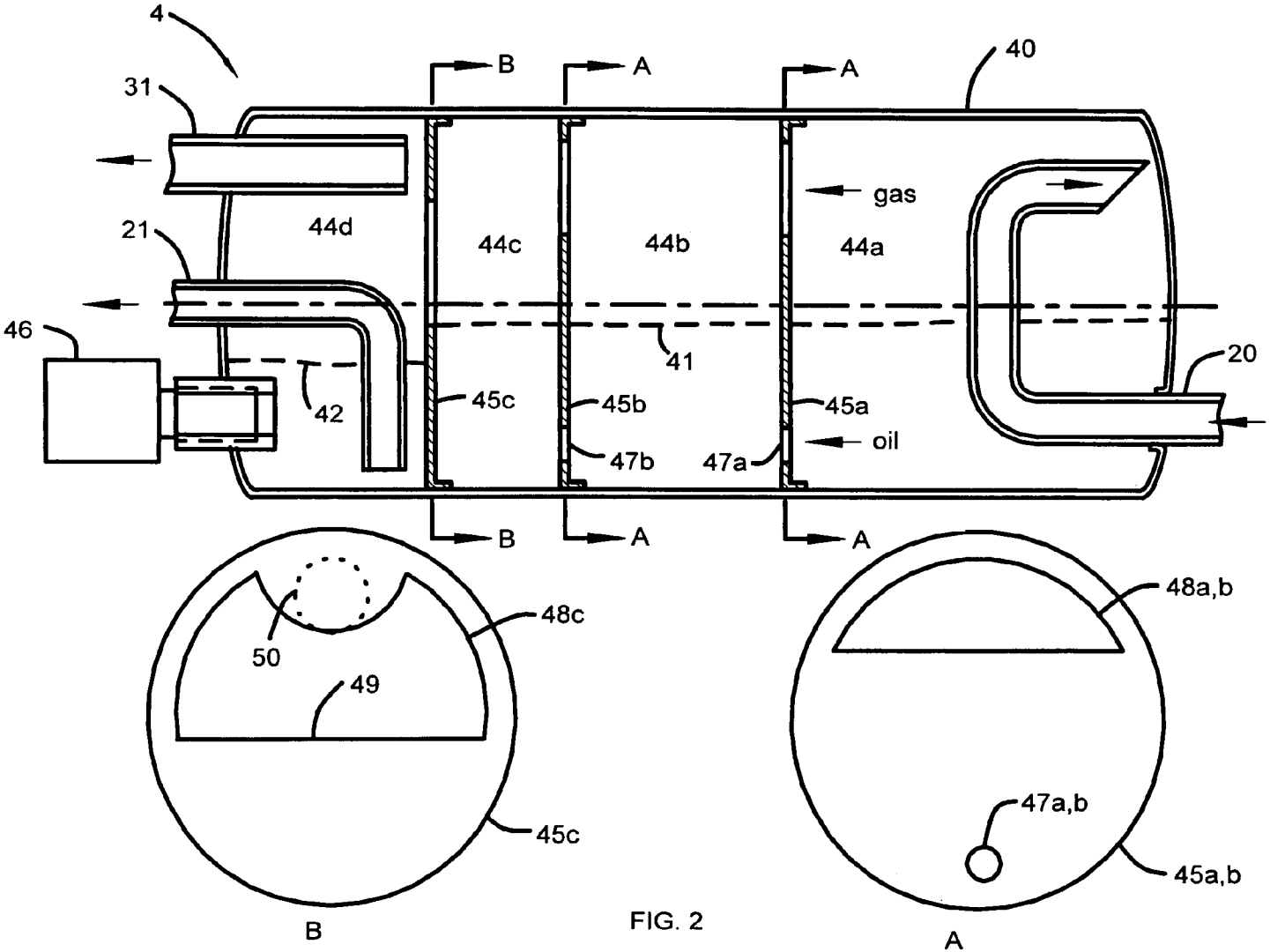
FIG. 2 is a schematic diagram illustrating the horizontal bulk oil separator in accordance with the present invention.

FIG. 2 indicates the details of construction of a preferred embodiment of the horizontal bulk oil separator of the present invention. The horizontal bulk oil separator 4 consists of shell 40, inlet tube 20, baffles 45*a*, 45*b*, 45*c*, oil outlet tube 21, gas outlet tube 31, and oil level sensor 46. Baffles 45*a*, 45*b*, and 45*c* are brazed into shell 40. The baffles divide the separator 4 into four sections, i.e., 44*a*, 44*b*, 44*c*, and 44*d*. Baffles 45*a* and 45*b* have cut-outs 48*a* and 48*b*, shown in the enlarged view 2A, above the centerline of separator 4 for gas to flow through them, and ports 47*a* and 47*b*, near the bottom of separator 4, for oil to flow from one section to the next. Baffle 45*c* has a single cut-out as shown in the enlarged view 2B that has lip 49 which maintains a minimum oil level in sections 44*a*, 44*b*, and 44*c*, at or above the level of this lip.

The term baffles as used herein refers to a plate or partition to impede the force or movement of the fluid. It is understood that any means so positioned in the bulk oil separator may be used to impede the force or movement of the fluid.

Oil that enters separator 4, along with helium, through line 20 is directed to impinge on the inside head of shell 40. This is frequently referred to as inertial separation, because the relatively light gas can turn easily while the dense oil continues on a straight path. Most of the oil is separated from the helium at this point. Oil is further separated from the gas as it impinges on the baffles. While several different types of packing, screens and scouring pads may be used in the sections between the baffles, an absence of packing was found to be the most effective. The inlet to gas outlet tube 31 is in close proximity to an area in baffle plate 45*c*, shown as 50, that causes the gas to turn 90° as it flows into the gas outlet tube. This is the final mechanism to separate oil from the gas. The end of tube 31 is spaced about ½ the inside diameter of 31 from baffle 50, and the area of 50 is about twice the inlet area of tube 31. The oil that drops into section 44*a* has a large amount of gas bubbles mixed with it. Most of these gas bubbles rise to the surface of the oil in sections 44*a*, 44*b*, and 44*c*, so the oil in section 44*d* is sufficiently free of bubbles that an opto-electronic oil level sensor functions normally or without error. The oil level in sections 44*a*, 44*b*, and 44*c*, denoted by dashed line 41, and the oil level in 44*d*, denoted by 42, have an initial level that is above lip 49. FIG. 2 shows the condition that exists as the oil level in section 44*d* has dropped below the level of lip 49. As can be observed, the horizontal bulk oil separator of the present invention is capable or rendering the helium virtually oil-free.

As used herein the term opto-electronic oil level sensor refers to electro-optic devices with built-in solid state switching electronics where optic technology detects the presence or absence of a fluid directly. It is understood that any other liquid level sensor known to those skilled in the art, either direct or indirect, including but not limited to, microprocessor-based sensors, fibro-optic or laser, electrochemical, optical, electronic, capacitance, float and conductance liquid level sensors may be utilized.

Figure 3:
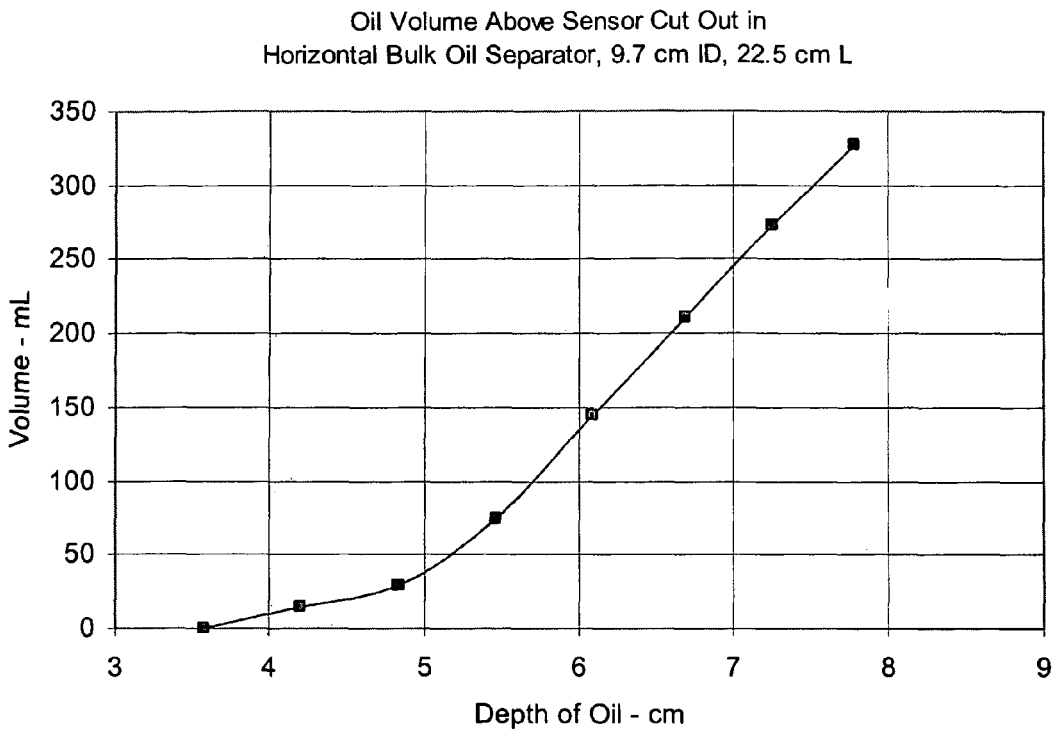
FIG. 3 is a graphical representation of the amount of oil in the bulk oil separator of FIG. 2 vs. the depth of oil above the cut-out point for the oil level switch.

FIG. 3 is a calculated plot of the amount of oil that can leave the bulk separator of the present design, versus the height of the oil above the inside bottom of separator 4. The amount of oil that is put in a new system is such that after an initial start up period, e.g. about 20 hours, there is between 200 and 300 mL of oil above the cut-out point for sensor 46. That is, the oil level will drop from a maximum of 7.5 cm to 3.5 cm before level sensor 46 opens and shuts down the compressor. The initial level is above the center line of the separator and drops in the entire separator until it reaches the height of lip 49, then only the level in section 44*d* drops until sensor 46 opens. Initially it drops 115 mL/cm, and then to about 30 mL/cm at the cut-out point. This provides a high level of sensitivity at the cut-out point. That is, the separator has an increase in the sensitivity to a change in oil level when the oil level drops below the lip 49 relative to when it is above the lip 49 by a factor of between about 2 and about 4, preferably between about 2.5 to about 3.8.

The present assignees have already disclosed an invention which contributes to an improvement of this type of oil-lubricated compressor. The bulk oil separator 4 is shown as having oil level switch 46. Since the oil level in compressor 2 is nearly constant, the oil level in the bulk oil separator drops over a long period of time as oil collects in adsorber 10. This provides a means of making the compressor "fail safe" as described in U.S. Pat. No. 6,488,120. This patent specifies that the compressor will shut down before the adsorber becomes more than about 75% loaded, oil (mist) never leaving the adsorber. The nearly constant oil levels in the compressor makes it possible to add oil above the level at which an oil level sensor or switch 46 opens to shut down the compressor without having a large difference between the maximum amount of extra oil that can be added and have it open with less than adsorber 8 being 75% loaded, and the minimum amount of oil that might collect in adsorber 8 when level switch 46 opens. The difference in the maximum and minimum oil levels being due to a tolerance on the initial oil charge in the system and changes in oil level during operation at different temperatures and pressures.

Figure 4:
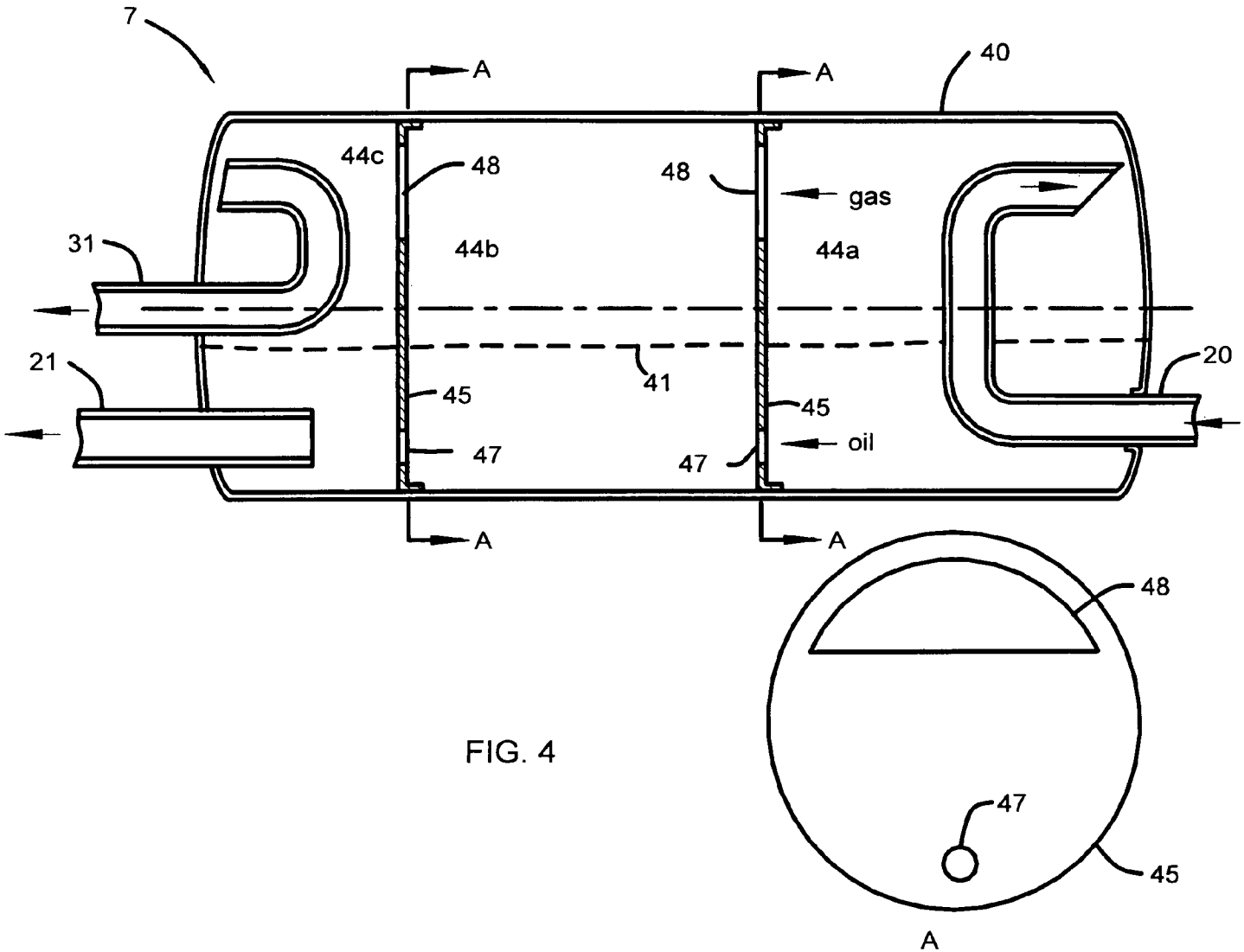
FIG. 4 is a schematic diagram illustrating an alternate embodiment of the horizontal bulk oil separator in accordance with the invention.

FIG. 4 is an alternative embodiment drawing of an alternate design of a horizontal bulk oil separator/reservoir in accordance with the present invention that embodies the essential features the separator of FIG. 2 but does not include an oil level detector. The essential features are the outlet of tube 20 that brings an oil/gas mixture into separator 7 being directed to impinge on the inside head of shell 40, one or more baffle plates like 45 that have upper cut-out 48 for gas and lower port 47 for oil. The inlet of outlet gas tube 31 is within ½ the tube diameter of the end of shell 40 causing the gas to make a 90° turn as a final stage of separation. Oil level 41 is the same in all sections of separator 5 and may be above or below the centerline of shell 40. Cut-outs 48 are always above oil level 41 and ports 47 are always below oil level 41. The residence time of the gas is between about 0.1 to 1.5 seconds, preferably about 0.3 to about 1.0 seconds. The residence time of the oil is between about 2 to about 10 seconds, preferably between about 3 to about 7 seconds. High oil level results in shorter residence time for the gas in the bulk oil separator and thus there will be a slightly higher fraction of oil in the gas leaving through tube 31, while a low oil level results in a shorter residence time for the oil in the bulk oil separator and thus a slightly higher amount of gas in the form of bubbles in the oil leaving through tube 21. As can be appreciated from FIG. 4, the horizontal oil separator and reservoir maintains a very high performance (although less than that of the preferred embodiment), and is of compact design.

It is understood that while there is a specific bulk oil separator, equivalent performance can be obtained in smaller or larger sizes by using three scaling parameters, 1) gas residence time, 2) oil residence time, and 3) percentage of oil removed from the gas. A forth parameter, the amount of gas in the oil, is hard to quantify and as used herein is defined as being sufficiently low that an opto-electronic level sensor gives a reliable signal.

As used herein, gas residence time is defined as the average time that it takes for gas to flow through the bulk oil separator, i.e., the time available for oil to be removed from the gas.

As used herein, oil residence time is the average time it takes for oil to flow through the bulk oil separator, i.e., the time available for gas to be removed from the oil. The percentage of oil removed from the gas could alternately be expressed as the fraction of oil that leaves with the gas.

Example 1

The bulk oil separator used in the present compressor system, as shown in FIG. 2, has an outside diameter of 10.15 cm (4.0") and a length of 22.8 cm (9.0"). Oil occupied approximately 50% of the volume. The compressor had a displacement of 98 mL, 338 L/min on 60 Hz power, and an oil circulation rate of about 7 L/min. The gas was helium, and the oil was UCON LBX300™ (LBX Company, LLC). The results obtained for the design and performance of the present horizontal bulk oil separator operating near the limits of test conditions are shown in Table I.

TABLE I

| | | |
|---|---|---|
| Internal volume of bulk oil separator - L | 1.6 | 1.6 |
| Test pressures - MPa | 2.0/0.4 | 2.1/0.8 |
| Volume of oil in bulk oil separator - mL | 500 | 800 |
| Gas flow rate - L/min | 69 | 132 |
| Oil flow rate - L/min | 8.9 | 7.1 |
| Residence time of gas - s | 0.95 | 0.36 |
| Residence time of oil - s | 3.3 | 6.7 |
| Oil in gas at outlet, max - mL/hr | 150 | 150 |
| Oil removal efficiency - % | 99.97 | 99.96 |
| Initial rate of oil level change - mL/cm | | 160 |
| Rate of oil level change at point where switch opens - mL/cm | 60 | |

When the measured rates of oil level change were compared with the calculated values shown in FIG. 3 the measured initial change of 160 mL/cm was higher than the 115 mL/cm that was calculated, and the measured change at cut-out of 60 mL/cm was greater than the calculated value of 30 mL/cm. Calculations assumed static conditions while the conditions during operation are very dynamic. The test results showed that the sensitivity to a change in oil level in section

44*d* increased by a factor of 160/60=2.7 when the oil level dropped below lip 49. The calculated increase in sensitivity was 115/30=3.8.

The minimum volume of oil in the bulk oil separator, 500 mL, is the oil in sections 44*a*, 44*b*, and 44*c* when oil level 42 is near the cut-out point. As indicated, the time available for gas bubbles to separate from the oil is the residence time of the oil in the bulk oil separator. Effective removal of gas from the oil has been demonstrated with a residence time of 3.3 seconds.

Example 1 and FIG. 3 demonstrate that the bulk oil separator is designed to allow up to 300 ml of oil to be transferred to the absorber before the level switch is tripped. This represents about 18% of the volume of the bulk oil separator, i.e. 300 ml/1600 ml.

Nothing herein is meant to limit the present invention. It is understood that the present invention may be used with other horizontal scroll compressors or other compressors such as the screw, reciprocating, centrifugal, vane and rotary wave types as well as other compression or noble gases, including natural gas and air.

While this invention has been described, it will be understood that it is capable of further modification, uses and/or adaptations, following in general the principal of the invention, and including such departures from the present disclosure as come within known or customary practice in the art to which the invention pertains, and as may be applied to the essential features hereinbefore set forth, as fall within the scope of the invention or the limits of the appended claims. Also, it is to be understood that the phraseology and terminology employed herein, as well as the abstract, are for the purpose of description and should not be regarded as limiting.

It is also understood that the following claims are intended to cover all of the generic and specific features of the invention described herein.

What is claimed is:

1. A horizontal bulk oil separator with an integral reservoir, the bulk oil separator comprising:

a shell;

passages for an inflow mixture of gas and oil to flow from an inlet to an outlet end within the shell;

an inlet tube that directs the inflow mixture to impinge on a first plate;

one or more baffles each having a single open and unobstructed cut-out for gas to flow above a level of the oil and a single port for the oil to flow near a bottom of the shell;

an outlet conduit having a first end disposed in an interior space of the shell, the first end comprising an entrance spaced from the shell, the outlet conduit for evacuating gas above the maximum oil level and an outlet port for oil near the bottom of the shell; and a uniform oil level that is above said outlet port for oil.

2. The horizontal bulk oil separator with an integral reservoir separator as in claim 1 wherein said impingement plate is the head of said shell.

3. The horizontal bulk oil separator with an integral reservoir as in claim 1 wherein a maximum change in oil volume in the separator is about 18% of the volume of the separator.

4. The horizontal bulk oil separator with an integral reservoir as in claim 1 wherein the position of the entrance to the outlet conduit effects a 90° turn of the gas as it enters.

5. The horizontal bulk oil separator with an integral reservoir as in claim 4 wherein a plate that effects the gas to make a 90° turn is part of the final baffle.

6. The horizontal bulk oil separator with integral reservoir as in claim 1 wherein a residence time of the gas is between about 0.3 and about 1 second in a length of 22.8 cm.

7. The horizontal bulk oil separator with integral reservoir as in claim 6 wherein a residence time of the oil is between about 2 and about 10 seconds.

8. The horizontal bulk oil separator of claim 1, wherein the entrance of the outlet conduit is disposed proximal to a second plate.

9. The horizontal bulk oil separator of claim 8, wherein the first and second plate are portions of the shell.

10. The horizontal bulk oil separator of claim 8, wherein the first and second plate are disposed on opposite ends of the shell.

11. The horizontal bulk oil separator of claim 8, wherein the entrance for the outlet port for gas is spaced within ½ of a diameter of the outlet port from the second plate.

12. A horizontal bulk oil separator with integral reservoir, the bulk oil separator comprising:

a shell;

a means for directing an inflow mixture to impinge upon an inlet head of the bulk oil separator;

one or more baffles each having means for gas to flow through a single open and unobstructed cut-out above a level of oil and a single means for oil to flow near a bottom of the shell;

an outlet conduit having a first end disposed into an interior space of the shell, the first end having an entrance spaced from the shell conduit for directing an outflow of gas; and a means for directing an outflow of oil.

13. The horizontal bulk oil separator of claim 12, wherein an entrance for the outlet conduit is disposed proximal to a portion of the shell.

14. The horizontal bulk oil separator of claim 13, wherein the portion of the shell is an exit head of the shell.

15. The horizontal bulk oil separator of claim 13, wherein the entrance for the outlet conduit is spaced within ½ of a diameter of the outlet port from the portion of the shell.

* * * * *